US006874265B1

(12) United States Patent
Pathak

(10) Patent No.: US 6,874,265 B1
(45) Date of Patent: Apr. 5, 2005

(54) FINGERPRINT SAFETY LOCK FOR FIREARMS

(76) Inventor: Sumit M. Pathak, 4407 NW. 49th Dr., Tamarac, FL (US) 33319

( * ) Notice: Subject to any disclaimer, the term of this patent is extended or adjusted under 35 U.S.C. 154(b) by 0 days.

(21) Appl. No.: 10/839,909

(22) Filed: May 7, 2004

(51) Int. Cl.[7] ..... F41A 17/00
(52) U.S. Cl. ..... 42/70.06; 42/70.07
(58) Field of Search ..... 42/70.06, 70.07; 224/244

(56) References Cited

U.S. PATENT DOCUMENTS 5,603,179 A * 2/1997 Adams ..... 42/70.08
5,720,193 A * 2/1998 Dick ..... 70/298
5,812,252 A 9/1998 Bowker et al.
5,937,557 A 8/1999 Bowker et al.
6,230,946 B1 5/2001 Vor Keller et al.
6,253,480 B1 7/2001 Florez
6,320,975 B1 11/2001 Vieweg
6,533,149 B2 3/2003 Vor Keller et al.
6,552,963 B2 4/2003 Baranek et al.
6,588,635 B2 7/2003 Vor Keller et al.
6,631,579 B1 * 10/2003 Lauster et al. ..... 42/70.11
6,678,984 B1 * 1/2004 Rapp et al. ..... 42/70.11
6,718,679 B2 * 4/2004 Herzog ..... 42/70.07
2002/0069569 A1 * 6/2002 Riebling et al. ..... 42/70.07
2002/0153396 A1 * 10/2002 French et al. ..... 224/244

* cited by examiner

*Primary Examiner*—J. Woodrow Eldred
(74) *Attorney, Agent, or Firm*—John D. Gugliotta; Olen L. York, III

(57) ABSTRACT

A locking system for firearms that utilizes an owner's fingerprint to lock and unlock it is disclosed. Upon initial observation of the invention, it appears like a conventional fire arm lock that goes around the trigger and immobilizes it. Fingerprint sensors are provided that will only acknowledge the fingerprint and thumb print of the gun owner. When the owner touches the sensors once, the present invention will unlock, and when they are touched again, it will lock. A small computerized chip, in conjunction with a lithium battery and an advancement mechanism such as a stepper motor perform the actual locking duties. The housing of the invention is made of titanium to prevent tampering.

6 Claims, 3 Drawing Sheets

FINGERPRINT SAFETY LOCK FOR FIREARMS

RELATED APPLICATIONS

The present invention contains subject matter that was first described in Disclosure Document Registration 544,266 filed on Dec. 29, 2003 under 35 U.S.C. §122 and 37 C.F.R. §1.14. As such, it is respectfully requested that said Disclosure Document remain a permanent part of the file history of the present application and be relied upon during the pending prosecution, and for any other matters that may arise.

There are no previously filed, nor currently any co-pending applications, anywhere in the world.

BACKGROUND OF THE INVENTION

1. Field of the Invention

The present invention relates generally to firearm safety lock mechanisms, and, more particularly, to a firearm safety lock mechanism employing a fingerprint recognition system.

2. Description of the Related Art

All too often we hear of children or other adults who have accidentally been shot with a handgun. While the causes are many and the blame can be distributed to all involved parties, the simple fact remains that a proper locking mechanism could eliminate most all of these tragedies. There are different methods of securing guns against unauthorized used, but they all have some disadvantages associated with them. If the gun is secured in a locked cabinet, it is not readily available for use in self defense. Trigger locks are also cumbersome should the keys become lost or needed quickly. Finally, all methods that rely on keys to secure the locking means are subject to picking or unauthorized key copying.

A search of the prior art did not disclose any patents that read directly on the claims of the instant invention; however, the following references were considered related.

| U. S. Pat. No. | Description |
|---|---|
| 6,230,946 | Safety holster for preventing access to a firearm by unauthorized users |
| 6,588,635 | Safety holster for preventing access to a firearm by unauthorized users |
| 6,552,963 | Firearm discharge detection device and warning system |
| 5,937,557 | Fingerprint-acquisition apparatus for access control; personal weapon and other systems controlled thereby |
| 5,812,252 | Fingerprint-Acquisition apparatus for access control; personal weapon and other systems controiled thereby |
| 6,320,975 | Firearm holster lock with fingerprint identification means |
| 6,533,149 | Safety holster for preventing access to a firearm by unauthorized users |
| 6,253,480 | Personalized safety device for a hand held weapon |

Consequently, there is a need for a means by firearms can be secured so that they are impossible to fire, but can be quickly accessed in the event that the handgun is needed.

SUMMARY OF THE INVENTION

It is therefore an object of the present invention to provide an improved firearm safety lock mechanism.

It is a feature of the present invention to provide an improved firearm safety lock mechanism employing a fingerprint recognition system.

Briefly described according to one embodiment of the present invention, a locking system for firearms that utilizes an owner's fingerprint to lock and unlock it is disclosed. However, in lieu of a conventional tumbler type lock, fingerprint sensors are provided. The sensors will only acknowledge the fingerprint and thumb print of the gun owner. When the owner touches the sensors once, the present invention will unlock, and when they are touched again, it will lock. A small computerized chip, in conjunction with a lithium battery and an advancement mechanism such as a stepper motor perform the actual locking duties. The housing of the invention is made of titanium to prevent tampering.

The use of the present invention allows one to ensure that handguns and similar firearms are secure from unauthorized or accidental use without the inefficiencies of conventional weapon locking means such as trigger locks and the like.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

The best mode for carrying out the invention is presented in terms of its preferred embodiment, herein depicted within the FIGS. 1 through 4.

1. Detailed Description of the Figures

Figure 1:
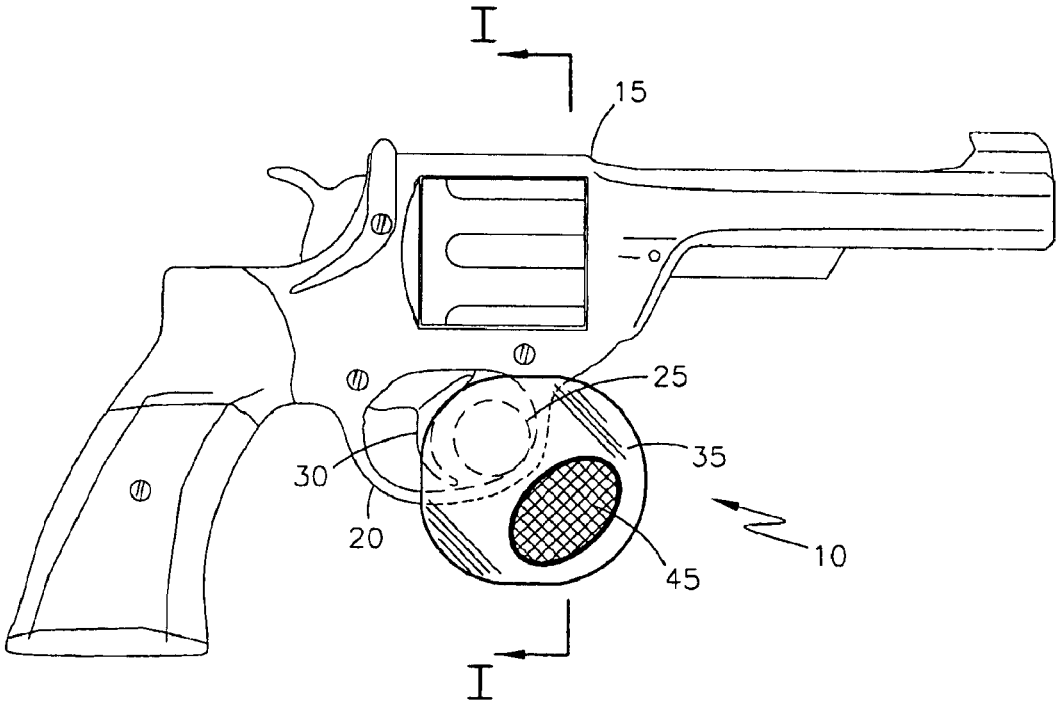
FIG. 1 is a side view of the firearm safety lock system employing fingerprint recognition system 10 shown in an utilized state on a conventional firearm 15, according to the preferred embodiment of the present invention.

Referring now to FIG. 1, a side view of the firearm safety lock system employing fingerprint recognition system 10 shown in an utilized state on a conventional firearm 15, according to the preferred embodiment of the present invention is disclosed. It should be noted that while the conventional firearm 15 is depicted as a revolver in this FIG., the firearm safety lock system employing fingerprint recognition system 10 will function equally well on any type of firearm such as an automatic handgun, rifle, shotgun or the like, and as such, should not be interpreted as a limiting factor of the present invention. The firearm safety lock system employing fingerprint recognition system 10 is located adjacent next to the trigger guard 20, in which the hidden portion of said firearm safety lock system employing fingerprint recognition system 10 is depicted by a dashed hidden line. An internal locking member 25, also depicted by a dashed hidden line in a generally circular shape, is shown engaging a trigger 30, thus preventing its activation and firing. A first outer enclosure 35 provides general overall containment of the components of the firearm safety lock system employing fingerprint recognition system 10. A second outer enclosure 40, (not visible in this FIG., for purposes of clarity) is located in a mirror image position on the opposite side of the conventional firearm 15 and will be disclosed in greater detail herein below. Finally a first fingerprint sensor 45 is located in a prominent position on the first outer enclosure 35. In a similar manner, a second fingerprint sensor 50 (not visible in this FIG., for purposes of clarity) is located in a similar position on the second outer enclosure 40 (not visible in this FIG., for purposes of clarity). The functionality of the first fingerprint sensor 45 and the second fingerprint sensor 50 allow the user to pickup the conventional firearm 15 with the firearm safety lock system employing fingerprint recognition system 10 engaged, touch the first fingerprint sensor 45 with their index finger, while at the same time touching the second fingerprint sensor 50 with their thumb. In the case of a desired match, the first outer enclosure 35 and the second outer enclosure 40 will open up and fall away from the conventional firearm 15, thus rendering it available for immediate use. Should the fingerprints and thumb prints not match, the firearm safety lock system employing fingerprint recognition system 10 remains engaged, thus rendering the conventional firearm 15 unavailable for use or subsequent firing. Further disclosure of the operation of the firearm safety lock system employing fingerprint recognition system 10 will be disclosed below.

Figure 2:
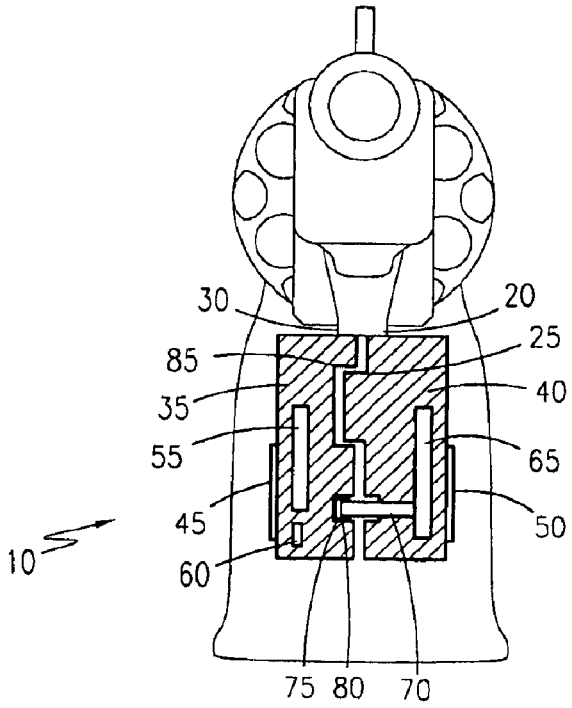
FIG. 2 is a sectional view of the firearm safety lock system employing fingerprint recognition system 10 in a locked state as seen along a line I—I as shown in FIG. 1.

Referring next to FIG. 2, a sectional view of the firearm safety lock system employing fingerprint recognition system 10 in a locked state as seen along a line I—I as shown in FIG. 1 is shown. This FIG. more clearly depicts the first fingerprint sensor 45 and the second fingerprint sensor 50 on the first outer enclosure 35 and second outer enclosure 40 respectively. The first outer enclosure 35 and the second outer enclosure 40 would be made of titanium or other similar high strength material that is resistant to tampering or cutting. A computer control chip 55 and a lithium battery 60 is located on the interior of the first outer enclosure 35, while an advancement mechanism 65 is located on the interior of the first fingerprint sensor 45. The advancement mechanism 65 is envisioned to be a stepper motor, solenoid, or other electro mechanical device which produces physical movement upon the application of an electric current. The mechanical output of the second fingerprint sensor 50 is physically connected to a first retractable rod 70 and a second retractable rod 75. The second retractable rod 75 is physically connected to the first outer enclosure 35 and slides around the first retractable rod 70 to produce an extended state and a retracted state, of which the retracted state is depicted here. The first retractable rod 70 slides within the second retractable rod 75 and has an anti-retraction mechanism 80, such as a mushroom head, which prevents the first outer enclosure 35 and the first fingerprint sensor 45 from separating. The first retractable rod 70 and the second retractable rod 75 are also made of titanium or other similar high strength material that is resistant to tampering or cutting. In the locked state as shown in this FIG., the internal locking member 25 is located inside of a receiving cavity 85 on the first outer enclosure 35. This feature provides a firm physical engagement of the trigger 30 about the trigger guard 20 preventing use of said trigger 30.

Figure 3:
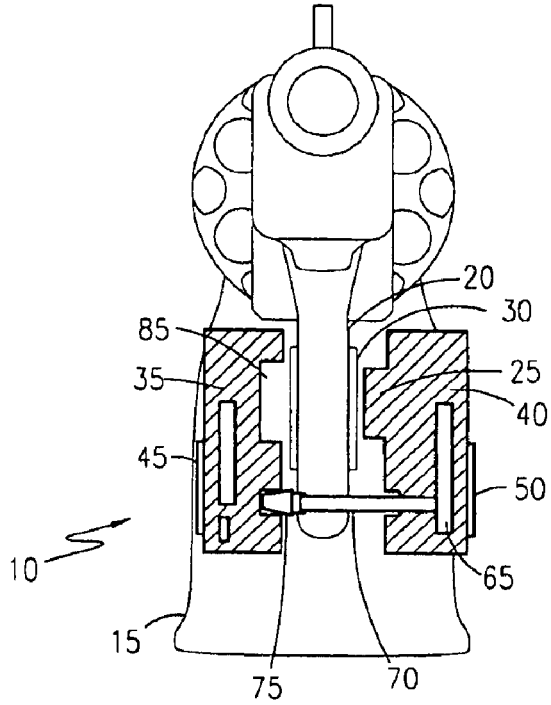
FIG. 3 is a sectional view of the firearm safety lock system employing fingerprint recognition system 10 in an unlocked state as seen along a line I—I as shown in FIG. 1; and, FIG. 4 is an electrical schematic block diagram depicting the internal circuitry of the firearm safety lock system employing fingerprint recognition system 10.

Referring now to FIG. 3, a sectional view of the firearm safety lock system employing fingerprint recognition system 10 in an unlocked state as seen along a line I—I as shown in FIG. 1 is depicted. This FIG. clearly depicts the release of the trigger guard 20 and trigger 30 from the internal locking member 25 and receiving cavity 85. This state occurs immediately after the authorized user has touched the first fingerprint sensor 45 with their index finger, while at the same time touching the second fingerprint sensor 50 with their thumb. This action causes the advancement mechanism 65 to extend the first retractable rod 70 and second retractable rod 75 thus separating the first outer enclosure 35 and the second outer enclosure 40 an adequate distance such that clearance is provided between the internal locking member 25 and receiving cavity 85 to clear the trigger guard 20. At this point, the firearm safety lock system employing fingerprint recognition system 10 can be removed from the conventional firearm 15, thus rendering it available for use.

Figure 4:
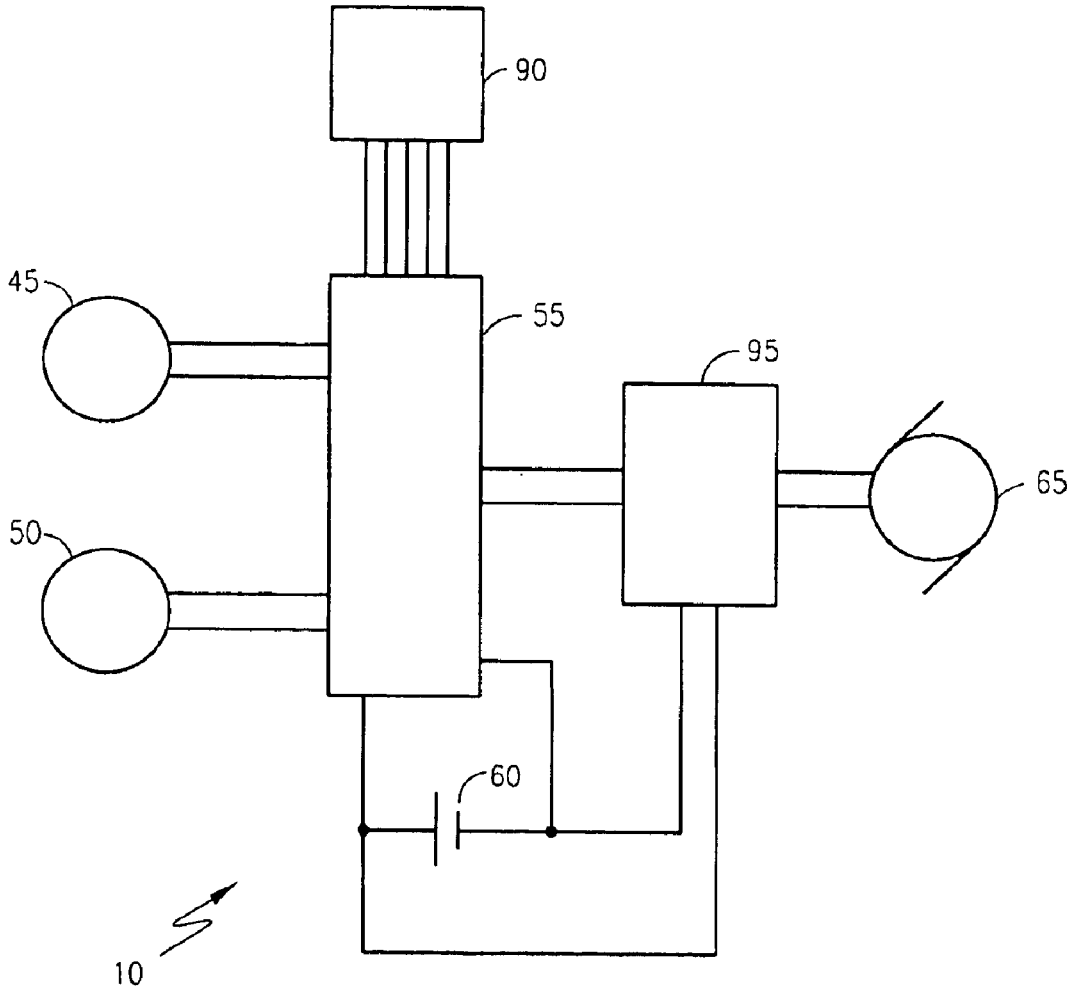

Referring finally to FIG. 4, an electrical schematic block diagram depicting the internal circuitry of the firearm safety lock system employing fingerprint recognition system 10 is disclosed. The first fingerprint sensor 45 and the second fingerprint sensor 50 are electrically connected to the computer control chip 55, envisioned to be a dedicated controller, although other logic circuits such as basic stamp modules and even hardwired logic could be used with equal effectiveness, and as such, should not be interpreted as a limiting factor of the present invention. The parameters of the authorized user's thumb print and index finer are stored in an electronic memory device 90 such as a random access memory module (RAM), which is compared to the submitted fingerprint and thumb print by the computer control chip 55. Should no match occur, no further action would be taken. If the submitted prints match those stored in the electronic memory device 90, an electronic signal would be provided to a latching circuit 95, such as a one-shot logic circuit. The latching circuit 95 would then engage the advancement mechanism 65 should it be disengaged or extended, and disengage the advancement mechanism 65 should it be engaged or retracted. In a simpler statement of operation, the user simply must touch the firearm safety lock system employing fingerprint recognition system 10 to lock it, and touch it again to unlock it in a repeating fashion. Power to the computer control chip 55 and latching circuit 95 is provided through the lithium battery 60.

It is envisioned that other styles and configurations of the present invention can be easily incorporated into the teachings of the present invention, and only one particular configuration shall be shown and described for purposes of clarity and disclosure and not by way of limitation of scope.

2. Operation of the Preferred Embodiment

The preferred embodiment of the present invention can be utilized by the common user in a simple and effortless manner with little or no training. Should a user wish to use a firearm safety lock system employing fingerprint recognition system 10 on his or her conventional firearm 15, it would be procured at a licensed dealer who would verify the user's identity and electronically load the fingerprint and thumb print information into the electronic memory device 90 of the firearm safety lock system employing fingerprint recognition system 10. A new lithium battery 60 would be installed, and the user instructed on the use and operation of the firearm safety lock system employing fingerprint recognition system 10. At this point the firearm safety lock system employing fingerprint recognition system 10 is ready for use.

While in its open or extended state as shown in FIG. 3, the user would place the firearm safety lock system employing fingerprint recognition system 10 about the trigger guard 20 and trigger 30 of a conventional firearm 15 to be equipped with the firearm safety lock system employing fingerprint recognition system 10. At this point, the user would touch the first fingerprint sensor 45 with their index finger, while at the same time touching the second fingerprint sensor 50 with their thumb. As aforementioned described, due to the matching nature of the fingerprint and thumb print furnished by the first fingerprint sensor 45 and second fingerprint sensor 50 respectively to the prints stored in the electronic memory device 90, the advancement mechanism 65 would retract closing the first outer enclosure 35 and the second outer enclosure 40 about the trigger guard 20 and trigger 30, thus rendering the conventional firearm 15 unavailable for use. To remove the firearm safety lock system employing fingerprint recognition system 10, the user would simply touch the first fingerprint sensor 45 and second fingerprint sensor 50 again, thus removing the firearm safety lock system employing fingerprint recognition system 10 and reversing the process. This same procedure would repeat in this described cyclical fashion thus keeping the conventional firearm 15 safe from accidental use, yet making it available for use in a timely fashion, free from the encumbrance of conventional locking systems.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A safety lock apparatus for a firearm comprising:

a first enclosure and a second enclosure, said enclosures mateable about a trigger of said firearm, one of said enclosures having an internal locking member positioned between said trigger and a trigger guard to inhibit activation of said trigger, wherein said enclosures have a first rod coupled to a second rod, said rods generating a retracted state for mateably locking said enclosures together, said rods generating an extended state for releasing said enclosures, and at least one finger print sensor placed on one of said enclosures, said sensor verifying authorization status of a user, wherein authorization of said user releases said enclosures and permits immediate use of said firearm.

2. The apparatus of claim 1, wherein said enclosures comprise:

a computer control chip operatively coupled to said at least one sensor;

electronic memory device storing finger print parameters of said user;

a latching circuit operatively coupled to an advancement mechanism, said latching circuit transmitting a signal generated by said electronic memory device to said advancement mechanism for directing engagement or disengagement of said advancement mechanism;

said advancement mechanism actuating retraction or expansion of said rods; and a battery supplying electrical power to said enclosure.

3. A safety lock apparatus for a firearm comprising:

a first enclosure and a second enclosure, said enclosures mateable about a trigger of said firearm, one of said enclosures having an internal locking member positioned between said trigger and a trigger guard to inhibit activation of said trigger; and an index finger print sensor and a thumb print sensor, said sensor verifying authorization status of a user, wherein authorization of said user releases said enclosures and permits immediate use of said firearm;

said index sensor positioned on one of said enclosures for verifying said user's index finger print for authorized use;

said thumb sensor positioned opposite to said index sensor and on the opposite enclosure, said thumb sensor for verifying said user's thumb print for authorized use; and said enclosures not released unless said index sensor and said thumb sensor match authorized prints.

4. The apparatus of claim 3, wherein said enclosures have a first rod coupled to a second rod, said rods generating a retracted state for mateably locking said enclosures together, said rods generating an extended state for releasing said enclosures.

5. The apparatus of claim 4, wherein said enclosures comprise:

a computer control chip operatively coupled to said at least one sensor;

electronic memory device storing parameters of said user;

a latching circuit operatively coupled to an advancement mechanism, said latching circuit transmitting a signal generated by said electronic memory device to said advancement mechanism for directing engagement or disengagement of said advancement mechanism;

said advancement mechanism actuating retraction or expansion of said rods; and a battery for supplying electrical power to said enclosure.

6. The apparatus of claim 5, wherein said advancement mechanism comprises an electro mechanical device that produces physical movement upon application of an electric current.

* * * * *